United States Patent [19]

Neufeld et al.

[11] 3,993,349

[45] Nov. 23, 1976

[54] INVALID SUPPORT DEVICE

[76] Inventors: Alonzo J. Neufeld, 1650 Parway Drive, Glendale, Calif. 91206; Hazel L. Hopson, 2423 Laughlin Drive, La Crescenta, Calif. 91214

[22] Filed: Aug. 8, 1975

[21] Appl. No.: 603,030

[52] U.S. Cl. ..... 297/6; 135/67; 272/70.3

[51] Int. Cl.[2] ..... A47D 13/04

[58] Field of Search ..... 272/70, 70.3, 70.4; 135/45 R, 45 A; 297/5, 6, 92

[56] References Cited

UNITED STATES PATENTS

| | | | |
|---|---|---|---|
| 1,349,674 | 8/1920 | Jenkins | 5/86 |
| 1,448,783 | 3/1923 | Blewitt et al. | 297/6 |
| 2,759,525 | 8/1956 | Ries | 272/70.4 X |

*Primary Examiner*—James C. Mitchell
*Attorney, Agent, or Firm*—Huebner & Worrel

[57] ABSTRACT

An invalid support device which includes the capabilities of acting as a back support for an invalid when in a sitting position and further to serve as a walker to support an invalid in a walking position and also including a seat support whereby the invalid may sit and rest within the invalid supporting device when it is utilized as a walker.

The device includes a frame structure and body support member which may be utilized in several positions on the invalid supporting device depending upon the use desired.

11 Claims, 10 Drawing Figures

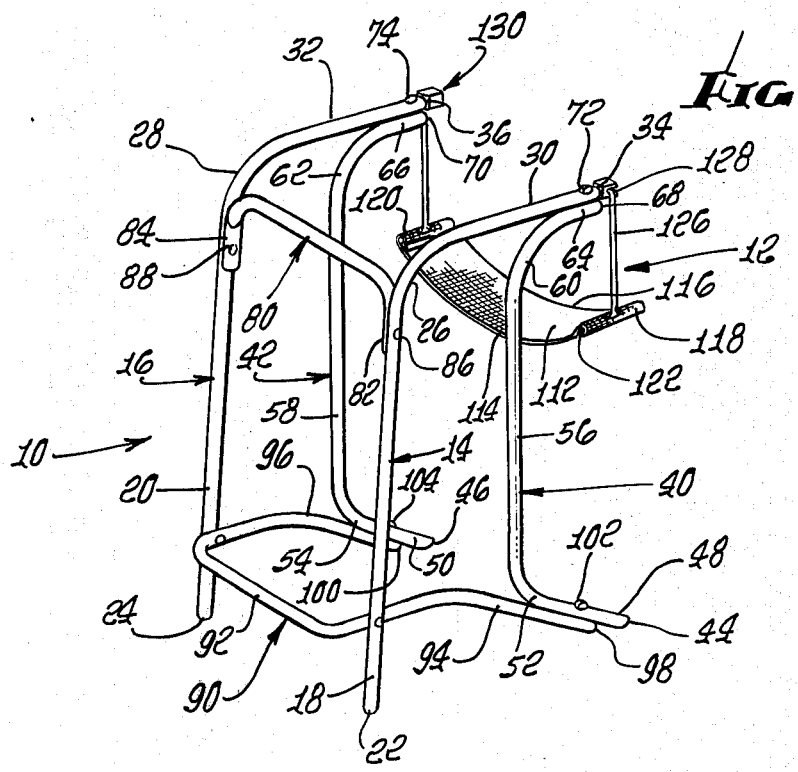
FIG. 1.
FIG. 1a.
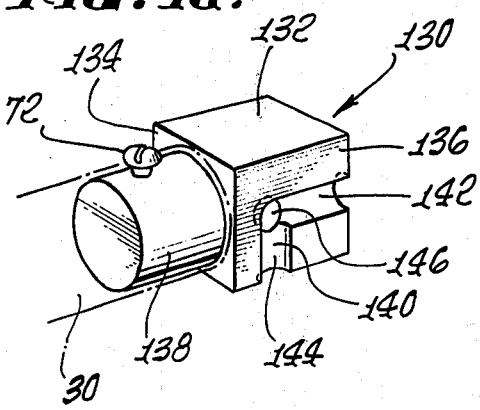
FIG. 2.
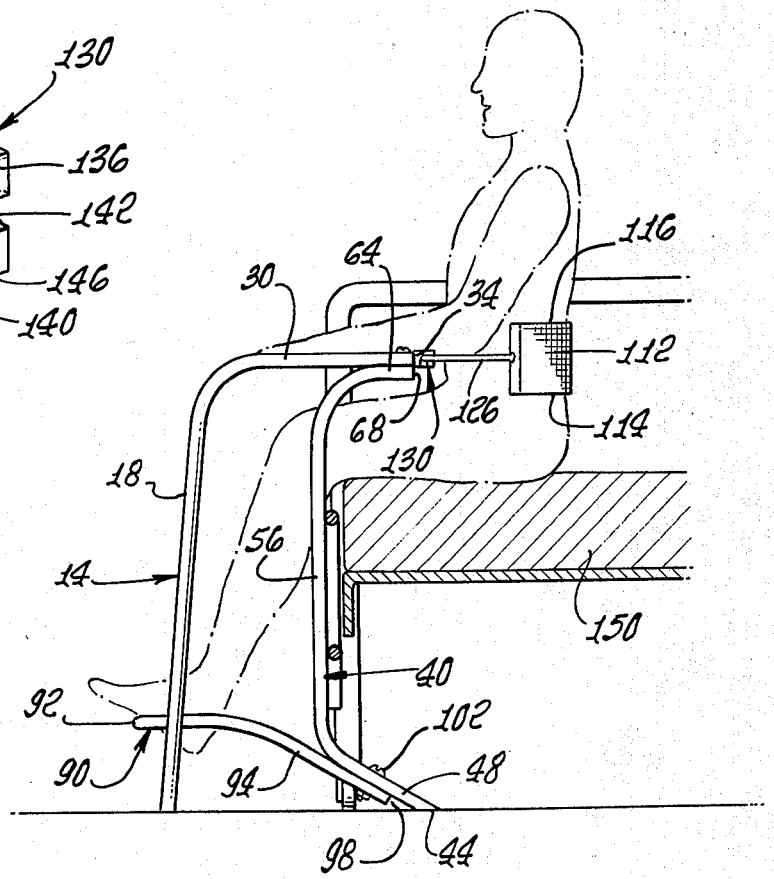

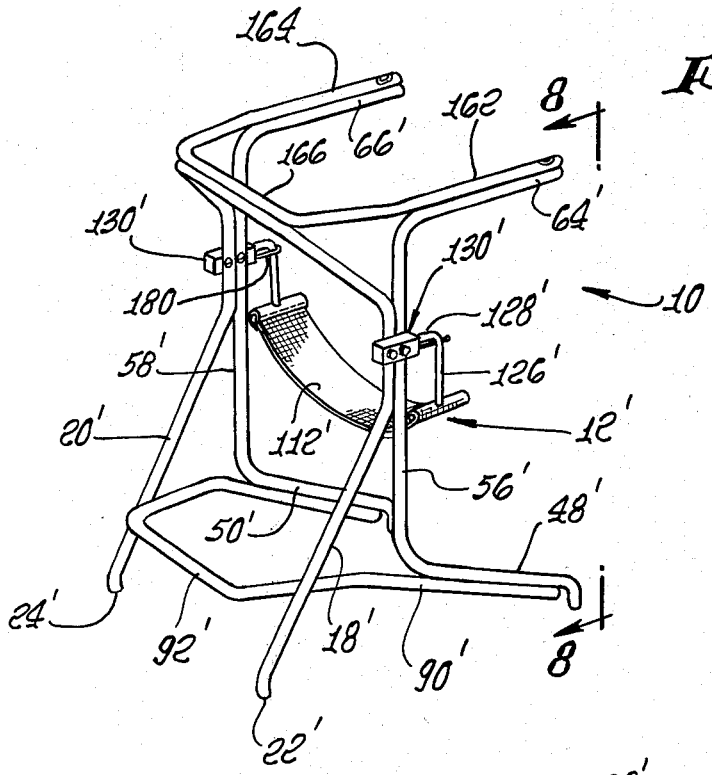
FIG. 7.
FIG. 8.
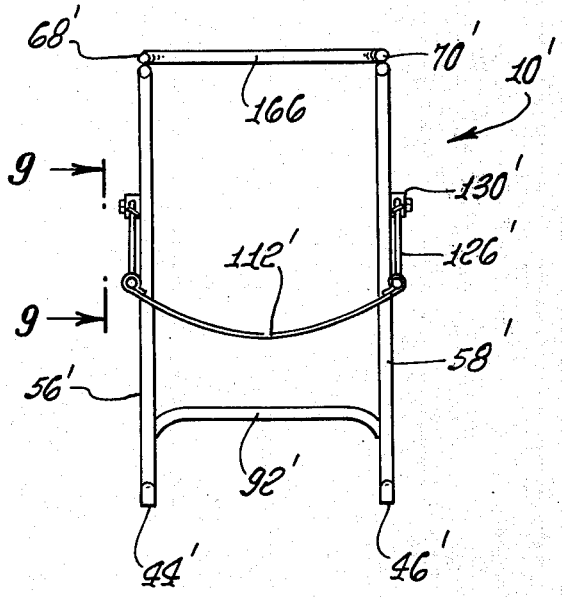
FIG. 9.
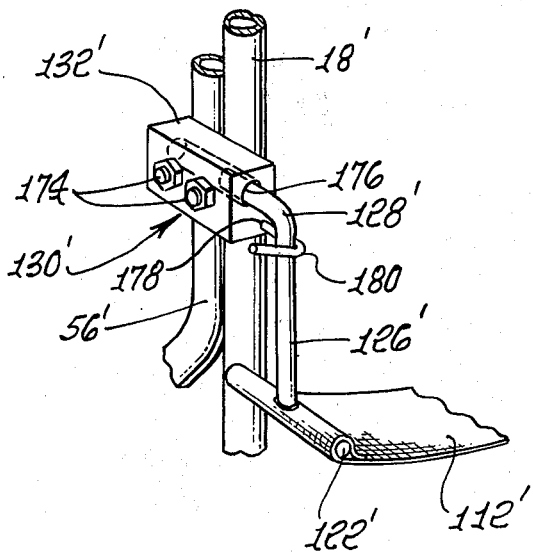

INVALID SUPPORT DEVICE

BACKGROUND OF THE INVENTION

For many years there have been available various types of structures designed to assist invalids in walking during a recuperative period after surgery or other hospital exposures. Some of the prior art devices have been frame devices with or without rollers. However, in the prior art of which applicants have knowledge there are no types of invalid supporting devices which can be utilized for more than one or possibly two purposes. In other words, the device has either been a walker per se or possibly a walker with some type of seat support structure. However, there are no such structures available which are adapted to be utilized with a patient when sitting at the edge of a bed and can also then be modified in a single structure to be used as a walker or to be used as a walker with a seat support sling.

SUMMARY OF THE INVENTION

The invention includes in vertical section a generally U-shaped frame structure of relatively light material which can be utilized as a support for an invalid when walking, to partially surround the invalid. Additionally the unit includes single structure which can be utilized as a back support for a patient or invalid when seated on a structure such as the edge of a hospital bed. Further, the single structure may be shifted on the frame structure whereby it can serve as a seat when the structure is being utilized as a walker support. Thus, when a patient or invalid becomes tired they may sit on the seat structure resting their body. The back or seat single structure include a sling member and support arms and on the frame structure specific mounting means are provided where the sling can be converted either from a backrest to a seat or vice versa. Additionally, the sling may be entirely removed so that the invalid supporting structure becomes strictly a walker to support a person when in a walking position.

Further, another advantage of the device is a locking means which may be utilized with the sling to maintain it in the desired one of two positions.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

FIG. 1 is a perspective view of the preferred embodiment of the invalid supporting device of this invention wherein the sling member is in a seat position.

FIG. 1*a* is an enlarged perspective view of the locking means for the sling.

FIG. 2 is a side elevational view of the structure illustrated in FIG. 1 being utilized by a person as a backrest support.

FIG. 7 is a perspective view similar to FIG. 3 with the exception that the sling portion has been secured on the invalid supporting device as a seat member.

FIG. 8 is an end elevational view taken on line 8—8 of FIG. 7.

FIG. 9 is a detailed perspective view of the sling member of FIG. 3 mounted as a seat portion and locking means for retaining the sling portion in position, taken on line 9—9 of FIG. 8.

DETAILED DESCRIPTION OF THE PREFERRED EMBODIMENTS

Figure 3:
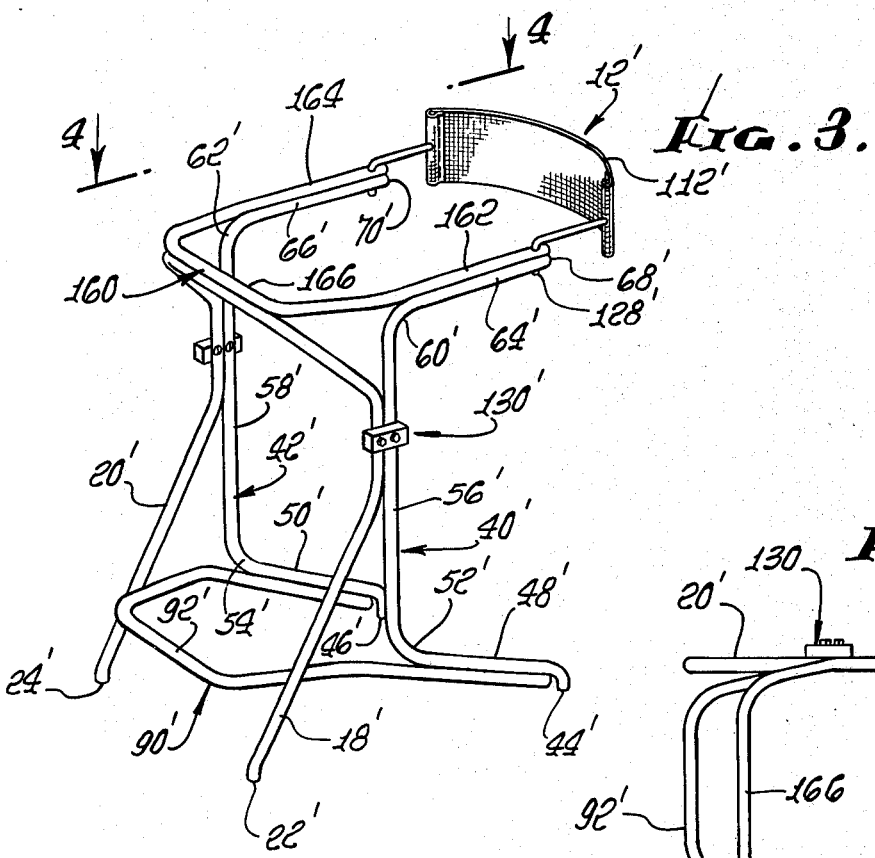
FIG. 3 is a perspective view of a modified form of the invalid supporting device of this invention wherein a sling member is in position for use as a backrest.

There is illustrated in the drawings the subject of this invention which is an invalid supporting device generally designated 10. The device includes a plurality of preferably tubular shaped members which are united to form the structure.

In addition to the supporting structure generally designated 10 there is provided a body support means generally designated 12 which when associated with the invalid supporting device 10 can be used as either a backrest or seat member.

The invalid supporting device 10 includes a pair of spaced apart forward leg structures 14 and 16 generally L-shaped in vertical elevation, each of which includes a generally upright leg 18 and 20 having ends 22 and 24 adapted to rest on the floor. Remote from the ends 22 and 24 the legs 18 and 20 are bent at 26 and 28 forming horizontal support arms 30 and 32, terminating in ends 34 and 36 respectively.

Rearwardly of the forward leg structures 14 and 16 and in vertical alignment therewith are a pair of rear support legs 40 and 42 generally U-shaped in vertical elevation. These legs 40 and 42 are each bent from tubing wherein there are ends 44 and 46 adapted to rest on the floor. From ends 44 and 46 sections 48 and 50 extend angularly forward and upwardly being bent at 52 and 54 and vertical sections 56 and 58 are formed extending upwardly and bent at 60 and 62 forming horizontal arms 64 and 66 terminating in ends 68 and 70. The arms 64 and 66 contact and underlie arms 30 and 32 respectively with ends 34 and 68 and 36 and 70 in vertical alignment.

The arms 30 and 64 and 32 and 66 are preferably united by welding or other means such as bolts 72 and 74 passing through the respective arms.

Extending between the legs 14 and 16 adjacent the bends 26 and 28 is a cross support bar 80 having end extensions 82 and 84 bent normal to bar 80 and adapted to engage legs 18 and 20 and secured thereto by welding or bolts 86 and 88 extending therethrough.

Finally, in the preferred embodiment a foot support member 90 is provided to be united with the legs 18 and 20 and the bent sections 48 and 50 of rear support legs 40 and 42. The foot support member 90 is generally U-shaped tubing formed of a footrest section 92 elevated above the ends 22 and 24 of legs 14 and 16 and extending from the ends of section 92 are generally parallel spaced apart leg extensions 94 and 96 each of which terminate in ends 98 and 100 under bent sections 48 and 50. The leg extensions 94 and 96 are secured to the sections 48 and 50 by welding or other means such as bolts 102 and 104.

Associated with the device 10 is a body support means generally designated 12. The body support means 12 preferably includes a sling 112 of canvas or other flexible material, and it is elongated and includes parallel elongated edges 114 and 116 and ends 118 and 120.

The respective ends 114 and 116 are looped over themselves and sewn or otherwise secured forming tubes 118 and 120. The sling 112 is secured to a pair of T-shaped bars having top T rods 122 mounted within the tubes 118 and 120, and arms 126 extending therefrom. The attaching portions of the arms 126 include hook portions 128 bent generally normal to the axis of the arms 126.

In order to retain the body support means 12 in position there is provided a pair of body support retention means generally designated 130, as best seen in FIG. 1a. The means 130 preferably each include a block 132 of metal or other relatively hard material having an inner face 134, and outer side face 136. In order to secure each of the blocks 132 within the support structure 10 each has a circular shank 138 having a diameter complementary with the inner diameter of horizontal arms 30 and 32 extending outwardly from the inner face 134 and is mounted within the ends 34 and 36. The set screws 72 and 74 can then pass through the tube 30, shank 138 and tube 64 and tube 32, shank 138 and tube 66 to maintain the assembly.

The outer side faces 136 of the blocks 132 each are provided with generally L-shaped circular channel 140 wherein there is a horizontal channel section 142 and a vertical channel section 144. Where the two sections 142 and 144 intersect a bore 146 is made inwardly from the side face 136. The diameter of the bore 146 and the channel sections 142 and 144 is complementary with the diameter of the hooks 128 and arms 126.

Thus with the aforedescribed structure it can be seen that with the arms 126 in a vertical position, FIG. 1, they are seated in channel sections 144 with the hook portions 128 within the bore 146 and they will remain in that position until moved. Additionally, with weight being placed on the sling 112 the respective arms 126 will be drawn toward each other and remain locked in the channel sections 144.

In the position of FIG. 1 a person can use the structure 10 as a walker by grasping the arms 30 and 32 with the body between the arms. When the patient becomes tired he may then sit in the sling 112 until strength returns and then stand and continue walking.

When it is desired to utilize the body support means 12 as a backrest, FIG. 2, the arms 126 are moved whereby they are positioned in the horizontal channel sections 142 where the sling is then in a vertical position.

In this position a patient may utilize a hospital bed 150 to sit on, the structure 10 being then placed adjacent the bed and partially around the patient, and the sling positioned as aforedescribed. Further, with the foot support member 90 elevated above the floor the patients feet may be placed thereon for additional comfort and to assist in counterbalancing the body weight against the sling 112.

The position illustrated in FIG. 2 is particularly useful during the first stage of patient recuperation when he can be moved from a lying position to a sitting position. As can be seen it only requires the swinging of the patient's legs over the edge of bed 150, without the necessity of moving the patient from a bed to a chair.

As the recuperative powers increase the structure 10 as seen in FIG. 1 can then be prepared and utilized.

In FIGS. 3 through 9 there is illustrated a modified form of invalid supporting structure 10'. Generally speaking, the frame members are tubular as in the preferred embodiment and of similar construction. The main difference resides in the body support retention means 130. In the embodiment of FIGS. 3 through 9 a body support retention means 130' is provided at a lower elevation when the body support member 12 is utilized as a seat as best seen in FIGS. 7 and 8. In view of the fact that people vary in height this particular embodiment is particularly suited to smaller people. Additionally, with the arrangement of FIGS. 7 and 8, the frame structure can also be used as a back support if desired by having the patient turn around and face rearwardly when sitting.

There is provided a front leg structure including legs 18' and 20' each of which terminating in ends 22' and 24'.

Rearwardly of the legs 18' and 20' are a pair of rear support legs 40' and 42' generally U-shaped in vertical elevation and vertically aligned with legs 18' and 20'. The rear support legs 40' and 42' are bent from tubing wherein there are ends 44' and 46' adapted to rest on the floor. From ends 44' and 46' sections 48' and 50' extend angularly forward and upwardly, being bent at 52' and 54' and vertical sections 56' and 58' are formed extending upwardly and bent at 60' and 62' forming horizontal arms 64' and 66', terminating in ends 68' and 70'.

The arms 64' and 66' contact and underlie a U-shaped horizontal member 160 which is formed with spaced apart parallel arm portions 162 and 164 each of which extend toward a cross member section 166 and are in reality continuations of the cross member 166.

The arms 64' and 162 and 66' and 164 are preferably welded or otherwise secured together.

There is also included a foot support member 90' which is almost identical in shape to the preferred embodiment and is provided to be united with the legs 18' and 20' and the bent sections 48' and 50' of rear support legs 40' and 42'. The foot support member 90' is generally U-shaped tubing formed of a foot rest section 92' elevated above the ends 22' and 24'.

Associated with the device 10' is a body support means generally designated 12' which includes a sling 112' similar to the sling of the preferred embodiment.

The main difference between the body support means 12' over the body support 12 of FIG. 1 is that the hook ends 128' are bent parallel with the top T rods 122'.

Figure 4:
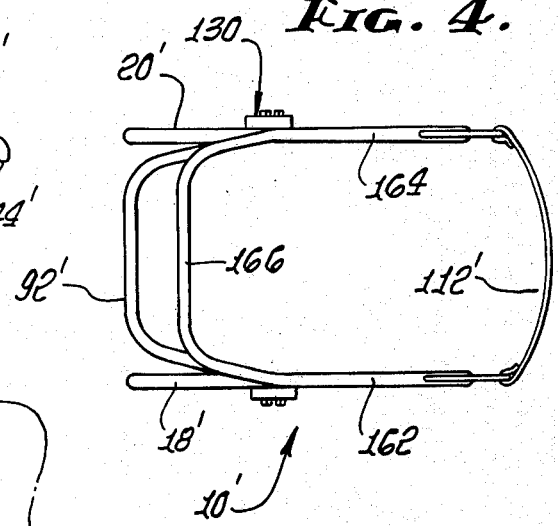
FIG. 4 is a top elevational view taken on line 4—4 of FIG. 3.
Figure 6:
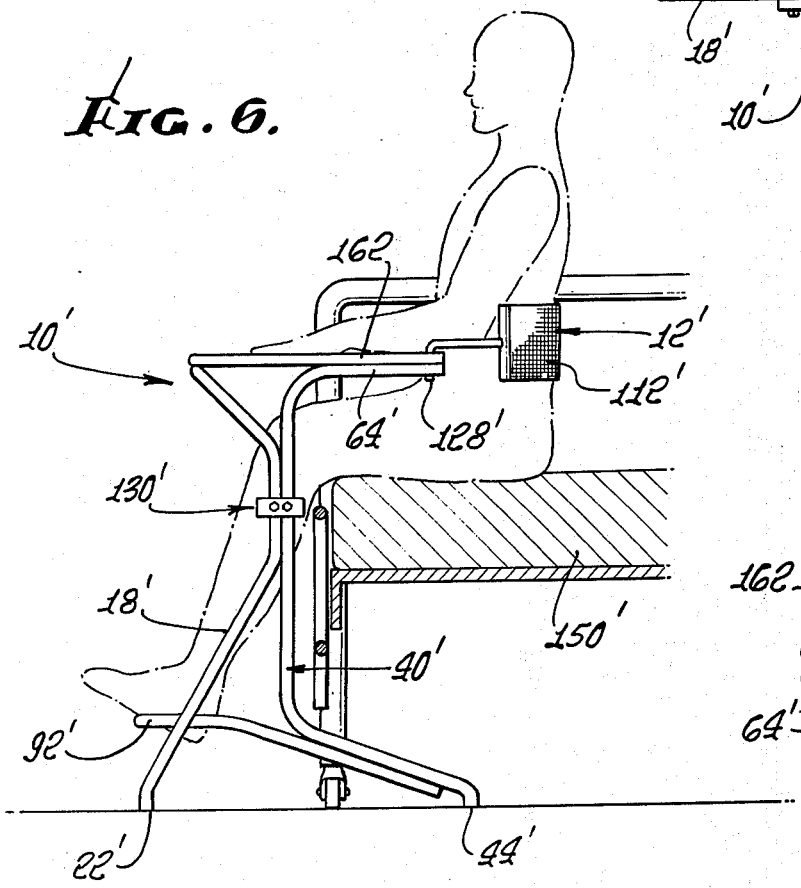
FIG. 6 is a side elevational view of the structure as illustrated in FIG. 3 being utilized by a person as a backrest support.
Figure 5:
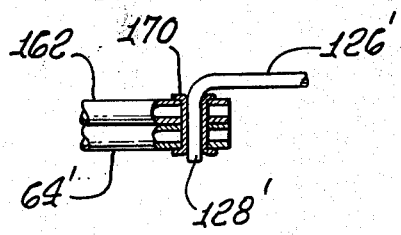
FIG. 5 is a side view partially in section of the attachment means for the sling member of FIG. 3.

As can be seen from FIGS. 3 through 5 when it is desired to utilize the body support means 12 as a back support for a patient seated upon a hospital bed 150', the hook portion 128 of the means 12 is inserted through the opening in a grommet 170 positioned in an opening bored through arms 64' and 162 as best seen in FIG. 5.

When it is desired to utilize the body support means 12' in a sitting position such as seen in FIGS. 7 through 9, there is provided a pair of body support retention means generally designated 130'. The means 130' include a block 132' of metal or other relatively hard material. The block 132' is preferably bolted to legs 56' and 18' and on the other side to legs 20' and 58' by means of bolts 174.

The blocks 132' are each further provided with an upper bore 176 extending horizontally from a rear face of the block inwardly a predetermined distance. Additionally there is formed a lower bore 178 of slightly less diameter than the bore 176 and extends a predetermined distance into the block 132. In order to create a seat from the body support means 12' the hooks 128' are positioned within the bore 176 so that the arms 126' of the means 12 extend downwardly. In order to maintain the arms 126' in position such as shown in FIG. 9, a lock pin 180 is inserted into bore 178 and is adapted to engage the arm 126'.

With the modification of FIGS. 7 through 9 it can be seen that even though there is a walker for the upright body support it may become necessary that a person sit and rest which heretofore has required the use of auxiliary chairs. With the device as illustrated in FIG. 7 the body support means 12' may be utilized as a seat for a patient during the advanced recuperative stages.

In both of the invalid supporting devices 10 and 10' the ends 22, 24, 44, 46, and 22', 24', 44' and 46' may be fitted with conventional rubber or plastic anti-skid caps.

Although we have herein shown and described our invention in what we have conceived to be the most practical and preferred embodiment, it is recognized that departures may be made therefrom within the scope of our invention.

We claim:

1. An invalid support device capable of serving as a walker to support a person when in a vertical walking position and to be utilized as a seat and alternatively to serve as a back support including:

a generally U-shaped frame member having ends for resting on a floor surface and rising to a height above said floor surface, said frame member having generally parallel spaced apart arm handle portions forming the upper limits of said frame member and terminating in rearwardly facing ends, and said frame member including a cross support member forwardly of and remote from said rearwardly facing ends;

foot rest means underlying said cross support member and elevated above said frame member ends and said floor surface;

a pair of body support retention means associated with said U-shaped frame member and being spaced apart at least the distance between said arm handle portions; and shiftable body support means mounted in said pair of body support retention means and extending therebetween, said body support means positionable as a seat and in the alternative as a backrest.

2. An invalid support as defined in claim 1 wherein said body support means includes a pair of shiftable mounting brackets and a flexible sling member extending therebetween.

3. An invalid support as defined in claim 1 wherein said foot rest means includes rearwardly extending legs vertically aligned with said arm handle portions.

4. An invalid support as defined in claim 2 wherein said pair of body support retention means each include a block having a portion insertable and maintained in said ends of said parallel arm handle portions, said blocks including bores therein of a diameter adapted to receive one of said shiftable mounting brackets and said flexible sling member extending therebetween, and channels provided in each of said blocks adapted to receive and maintain a shiftable mounting bracket in a vertical position and alternatively in a horizontal position.

5. An invalid support as defined in claim 4 wherein when said brackets are in a horizontal position said sling may partially surround a person in a sitting position when sitting on an object other than said invalid support and said sling will act as a back support.

6. An invalid support as defined in claim 5 wherein said foot rest means may be used by a person when in said sitting position.

7. An invalid support as defined in claim 4 wherein when said brackets are in a vertical position said sling will form a seat whereby a person utilizing said invalid support as a walker may sit.

8. An invalid support device capable of serving as a walker to support a person when in a vertical walking position and to be utilized as a seat and alternatively to serve as a back support for a person when in a sitting position, including:

a U-shaped frame member arranged on an elevated horizontal plane above a floor surface and having generally spaced apart parallel arm handle portions and a front cross member extending between said handle portions;

a pair of U-shaped rear braces each arranged on a vertical plane and having upper and lower leg portions with a vertical central portion extending between said leg portions, and said upper leg portion of each brace aligned with said arm handle portion of said U-shaped frame member and mounted thereto;

a forward leg structure generally U-shaped having a pair of vertically deployed legs aligned with said vertical central portion of each of said U-shaped rear braces, and said forward leg structure including a horizontal cross member united with said pair of vertically deployed legs and said cross member aligned with said front cross member of said U-shaped frame member and united therewith;

a pair of body support retention means associated with each of said vertically deployed legs of said forward leg structure and said vertical central portions of said U-shaped rear braces and adapted to secure said legs and said portions in fixed alignment;

foot rest means extending between said vertically deployed legs of said forward leg structure; and removable body support means including a flexible sling adapted to be interconnected with said body support retention means and extending therebetween to act as a seat and alternatively said body support means may be secured to said parallel arm handle portions and said flexible sling extends between the respective arm handle portions whereby when a person is sitting on an object said body support means may partially surround said person and said sling may act as a back support.

9. An invalid support as defined in claim 8 wherein said foot rest may be used by said person when in said sitting position.

10. An invalid support as defined in claim 8 wherein releasable lock pins are provided to secure each of said body support means to each of said body support retaining means.

11. An invalid support as defined in claim 8 wherein each of said retaining means includes an elongated block having a length greater than the thickness of said vertically deployed leg of said forward leg structure and said vertical central portions of said U-shaped rear brace, and a pair of fastening means extending through said block and said vertically deployed leg and said vertical central portion respectively.

* * * * *